US011686088B2

(12) United States Patent
Bunting

(10) Patent No.: US 11,686,088 B2
(45) Date of Patent: Jun. 27, 2023

(54) MOUNTED PANEL SYSTEMS AND METHODS

(71) Applicant: TREMCO CPG INC., Beachwood, OH (US)

(72) Inventor: John Richard Bunting, Nashville, TN (US)

(73) Assignee: TREMCO CPG INC., Beachwood, OH (US)

( * ) Notice: Subject to any disclaimer, the term of this patent is extended or adjusted under 35 U.S.C. 154(b) by 62 days.

(21) Appl. No.: 17/388,730

(22) Filed: Jul. 29, 2021

(65) Prior Publication Data

US 2022/0034086 A1 Feb. 3, 2022

Related U.S. Application Data

(60) Provisional application No. 63/058,729, filed on Jul. 30, 2020.

(51) Int. Cl.
*E04B 2/74* (2006.01)

(52) U.S. Cl.
CPC ..... *E04B 2/7403* (2013.01)

(58) Field of Classification Search
CPC ..... E04B 2/7403; E04F 13/0816; E04F 13/0875; E04F 13/083
See application file for complete search history.

(56) References Cited

U.S. PATENT DOCUMENTS

| | | | | |
|---|---|---|---|---|
| 2,082,314 | A | 6/1937 | Venzie | |
| 3,621,635 | A | 11/1971 | De Lange | |
| 3,998,016 | A | 12/1976 | Ting | |
| 5,094,051 | A * | 3/1992 | Miller | E04F 13/0805 52/235 |
| 5,197,246 | A | 3/1993 | Hill | |
| 5,301,484 | A | 4/1994 | Jansson | |
| 5,398,473 | A | 3/1995 | Chan | |
| 6,167,660 | B1 | 1/2001 | Sama | |
| 7,681,366 | B2 | 3/2010 | De Gobbi | |
| 7,748,182 | B2 | 7/2010 | McGee et al. | |
| 8,769,898 | B2 | 7/2014 | Carolan et al. | |
| 8,898,984 | B2 | 12/2014 | Winteler | |
| 9,169,641 | B2 | 10/2015 | Wickstrom | |
| 9,879,432 | B2 | 1/2018 | Oliver et al. | |
| D809,674 | S | 2/2018 | Singh | |
| 10,000,925 | B2 | 6/2018 | Dahlin | |
| 10,233,636 | B2 | 3/2019 | Kennedy | |
| 2003/0038222 | A1 | 2/2003 | Holmes | |
| 2005/0076611 | A1 | 4/2005 | Crawford | |
| 2010/0077676 | A1 | 4/2010 | Dobler | |

(Continued)

*Primary Examiner* — Patrick J Maestri
(74) *Attorney, Agent, or Firm* — Calfee, Halter & Griswold LLP

(57) ABSTRACT

A mountable panel includes a panel body and a hanger body. The panel body includes front, rear, longitudinal side and lateral side surfaces, and a channel having a recessed portion recessed from the rear surface and a leg portion extending into the panel body from a first longitudinal end of the recessed portion. The hanger body includes a base portion disposed in the recessed portion of the channel and recessed from the rear surface of the panel body, a leg portion extending forward from a first longitudinal end of the base portion and into the leg portion of the channel, and a hook portion extending rearward from the base portion.

20 Claims, 8 Drawing Sheets

(56) References Cited

U.S. PATENT DOCUMENTS

| | | | | |
|---|---|---|---|---|
| 2012/0151861 | A1 | 6/2012 | Mulhair | |
| 2013/0183088 | A1* | 7/2013 | Wilkinson, Jr. | F16B 3/00 403/354 |
| 2017/0159293 | A1 | 6/2017 | Haley et al. | |
| 2019/0169855 | A1 | 6/2019 | Czyz | |

* cited by examiner

MOUNTED PANEL SYSTEMS AND METHODS

CROSS-REFERENCE TO RELATED APPLICATION

This application claims priority to and all benefit of U.S. Provisional Patent Application Ser. No. 63/058,729, filed on Jul. 30, 2020, for MOUNTED PANEL SYSTEMS AND METHODS, the entire disclosure of which is fully incorporated herein by reference.

BACKGROUND

Exterior construction panels, such as insulating panels, are commonly attached to a substrate or exterior surface of a building by means of adhesive. Adhesive attachment methods typically require proper application by a skilled worker and are only available within a limited range of environmental conditions and a limited panel size. Also, such panels are not easily removable for replacement.

SUMMARY OF THE DISCLOSURE

In an exemplary embodiment of the present disclosure, a mountable panel includes a panel body and a hanger body. The panel body includes front, rear, longitudinal side and lateral side surfaces, and a channel having a recessed portion recessed from the rear surface and a leg portion extending into the panel body from a first longitudinal end of the recessed portion. The hanger body includes a base portion disposed in the recessed portion of the channel and recessed from the rear surface of the panel body, a leg portion extending forward from a first longitudinal end of the base portion and into the leg portion of the channel, and a hook portion extending rearward from the base portion.

In another exemplary embodiment of the present disclosure, a panel system includes a mounting rail and a panel. The mounting rail includes a base wall portion securable to a substrate, a bight portion extending forward from the base wall portion, and a flanged portion extending vertically upward from the bight portion. The panel includes a panel body and a hanger body. The panel body includes front, rear, longitudinal side and lateral side surfaces, and a channel having a recessed portion recessed from the rear surface and a leg portion extending into the panel body from a first longitudinal end of the recessed portion. The hanger body includes a base portion disposed in the recessed portion of the channel, a leg portion extending forward from a first longitudinal end of the base portion, into the leg portion of the channel, and a hook portion extending rearward from the base portion and over the flanged portion of the mounting rail to secure the panel on the mounting rail.

In another exemplary embodiment of the present disclosure, a method of constructing a mountable panel is contemplated. In the exemplary method, a panel body is provided having front, rear, longitudinal side and lateral side surfaces. A channel is formed in the panel body, with the channel including a recessed portion recessed from the rear surface and a leg portion extending into the panel body from a first longitudinal end of the recessed portion. A hanger body is provided having a base portion, a leg portion extending forward from a first longitudinal end of the base portion, and a hook portion extending rearward from the base portion. The hanger body is installed in the channel, such that the base portion is disposed in the recessed portion of the channel and recessed from the rear surface of the panel body, and the leg portion of the hanger body extends into the leg portion of the channel.

In another exemplary embodiment of the present disclosure, a method of mounting a panel to a substrate is contemplated. In the exemplary method, a mounting rail is provided having a base wall portion, a bight portion extending forward from the base wall portion, and a flanged portion extending vertically upward from the bight portion. The base wall portion is affixed to the substrate. A panel is provided, including a panel body and a hanger body. The panel body includes a channel having a recessed portion recessed from a rear surface of the panel body and a leg portion extending into the panel body from a first longitudinal end of the recessed portion. The hanger body includes a base portion disposed in the recessed portion of the channel, a leg portion extending forward from a first longitudinal end of the base portion into the leg portion of the channel, and a hook portion extending rearward from the base portion. The hook portion of the hanger body is inserted over the flanged portion of the mounting rail to secure the panel on the mounting rail.

BRIEF DESCRIPTION OF THE DRAWINGS

Further features and advantages of the invention will become apparent from the following detailed description made with reference to the accompanying drawings, wherein.

DETAILED DESCRIPTION

This Detailed Description merely describes exemplary embodiments and is not intended to limit the scope of the claims in any way. Indeed, the invention as claimed is broader than and unlimited by the described embodiments, and the terms used have their full ordinary meaning.

Wall mounted panels constructed from flexible and/or lightweight materials (e.g., polystyrene or other such foam insulating materials) often require rigid reinforcement and/or secure mounted attachment along the length of the panel, for example, to prevent or inhibit warping or detachment from the wall or other substrate. While adhesive alone may provide adequate panel retention in some applications, mechanical attachment may still be needed while the adhesive is permitted to cure. In other applications, ambient temperatures or other conditions at the time of installation may prevent or inhibit adequate adhesion.

The present disclosure contemplates a panel system that utilizes a mounting rail affixed to a wall or other substrate for mechanical mounting retention of one or more panels having one or more hanger elements embedded in the body of the panel and including an exposed rearward and downward extending hook portion that hooks over an upward extending flanged portion of the mounting rail to secure the panel on the mounting rail.

Figure 1:
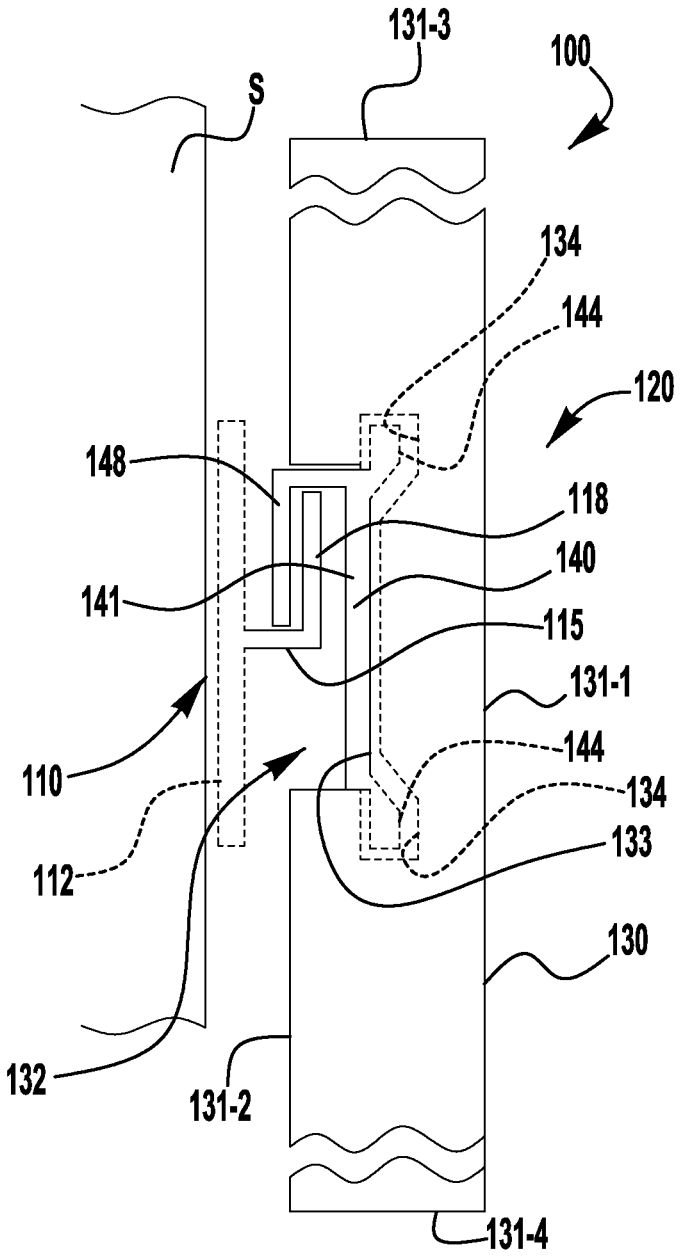
FIG. 1 illustrates a schematic cross-sectional view of a panel system, according to an exemplary embodiment of the present disclosure.

FIG. 1 schematically illustrates an exemplary panel system 100 including at least one mounting rail 110 and at least one panel 120. The mounting rail 110 includes a base wall portion (shown schematically at 112) securable to a wall or other substrate S (e.g., by one or more mounting screws or other fasteners installed through mounting holes in the base wall portion), a bight portion 115 extending forward from the base wall portion 112, and a flanged portion 118 extending vertically upward from the bight portion 115. The mounting rail may be provided in a suitable rigid material, including, for example, extruded aluminum, steel, and/or other metals.

The mounting rail 110 may be provided as an elongated rail having a longitudinal length sized to accommodate one or more panels 120. Alternatively, multiple shorter mounting rails may be affixed to a substrate to provide multiple discrete (e.g., approximately 3 inches long) supporting flanges for a hanger body of a panel. In some embodiments utilizing multiple discrete supporting flanges, the panel may be additionally secured to the substrate by an adhesive (e.g., a ⅜-½ inch thick layer of an acrylic-modified adhesive such as Dryvit Primus adhesive, AEPS, or Genesis).

Figure 2A:
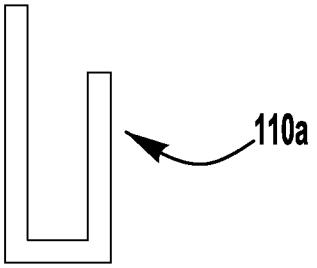
FIGS. 2A-2D schematically illustrate cross-sectional views of various mounting rails for a panel system, according to exemplary embodiments of the present disclosure.
Figure 2B:
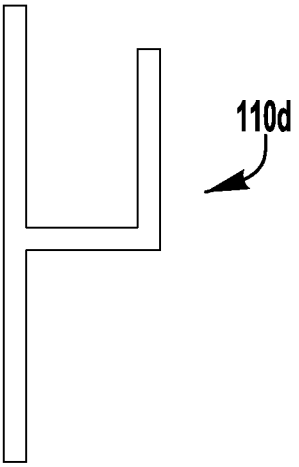
Figure 2C:
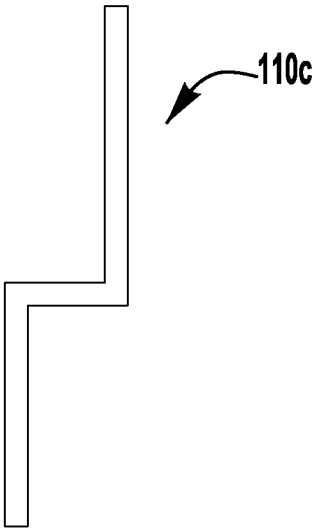
Figure 2D:
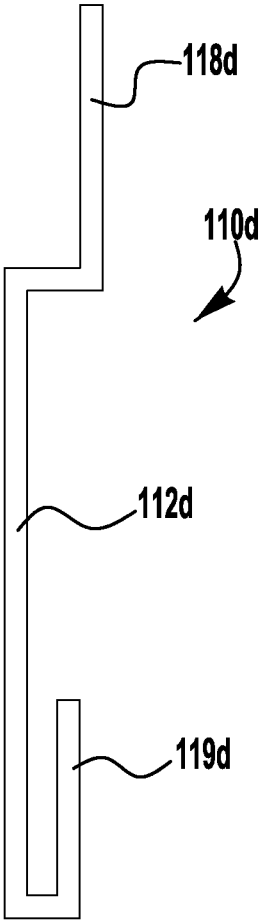

The mounting rail may, but need not, have a substantially uniform cross-sectional shape along its length. A variety of suitable cross-sectional shapes may be utilized, such as, for example, a U-shaped or J-shaped mounting rail 110*a* (FIG. 2A), a Y-shaped mounting rail 110*b* (FIG. 2B) or a Z-shaped mounting rail 110*c* (FIG. 2C). In other embodiments, as shown in FIG. 2D, the mounting rail 110*d* may include two or more flanged portions 118*d*, 119*d* extending from a base wall portion 112*d*, for example, to accommodate multiple panels or to support a panel having multiple, vertically spaced or offset hanger bodies. In other arrangements, multiple, vertically spaced mounting rails may be affixed to a substrate to accommodate multiple panels or to support a panel having multiple, vertically spaced hanger bodies.

Referring back to FIG. 1, the panel 120 includes a panel body 130 and a hanger body 140 embedded in the panel body. The panel body 130 includes a front surface 131-1, a rear surface 131-2, longitudinal (e.g., top and bottom) side surfaces 131-3, 131-4, and lateral (e.g., left and right) side surfaces. A channel 132 is formed in the panel body 130, having a recessed portion 133 recessed from the rear surface 131-2 and a leg portion (shown schematically at 134) extending into the panel body 130 (e.g., toward the front surface 131-1 and/or toward the top longitudinal surface 131-3) from a first end of the recessed portion 133. The panel body may be formed from a variety of materials, including, for example, expanded polystyrene and/or other foam insulating materials. In some embodiments, the panel body may include one or more exterior coatings or coverings that define the outer surfaces of the panel body.

The hanger body 140 includes a base portion 141 disposed in the recessed portion 133 of the channel, a leg portion (shown schematically at 144) extending from a first longitudinal end of the base portion, into the leg portion 134 of the channel 132, and a hook portion 148 extending rearward from the base portion 141 and over the flanged portion 118 of the mounting rail 110 to secure the panel 120 on the mounting rail. Additionally or alternatively, the hanger body 140 may include a leg portion (shown schematically at 147) extending from a second longitudinal end of the base portion 141, into a lower leg portion 137 of the channel 132.

To allow the rear surface 131-2 of the panel body 130 to abut or closely align with the mounting surface of the substrate S, the recessed portion 133 of the channel 132 may be sized such that the base portion 141 of the hanger member 140 is recessed from the rear surface 131-2 of the panel body 130, allowing the flanged portion 118 of the mounting rail 110 to be at least partially received in the recessed portion 133 of the channel 132. The hook portion 148 of the hanger body 140 may (but need not) extend or protrude rearward beyond the rear surface 131-2 of the panel body 130. The hanger body may be provided in a suitable rigid material, including, for example, extruded aluminum, steel, and/or other metals.

Figure 3A:
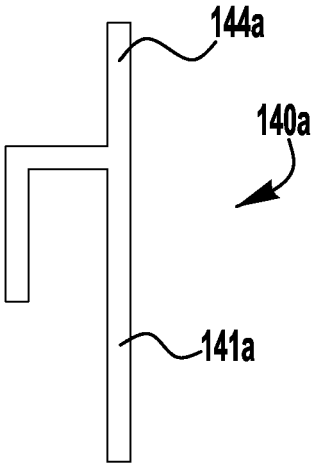
FIGS. 3A-3H schematically illustrate cross-sectional views of various hanger bodies for a panel system, according to exemplary embodiments of the present disclosure.
Figure 3B:
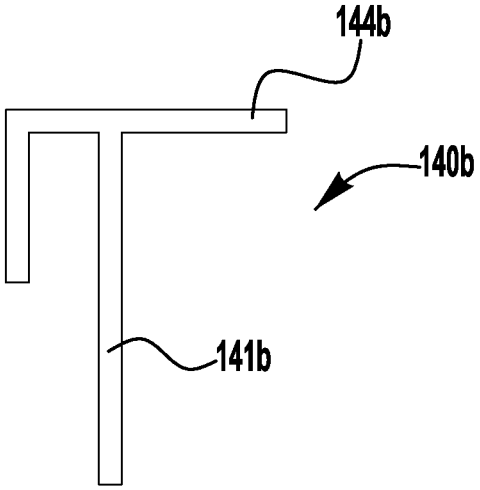
Figure 3C:
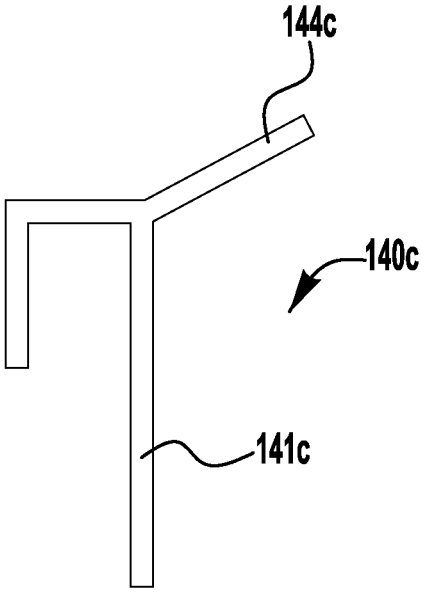
Figure 3D:
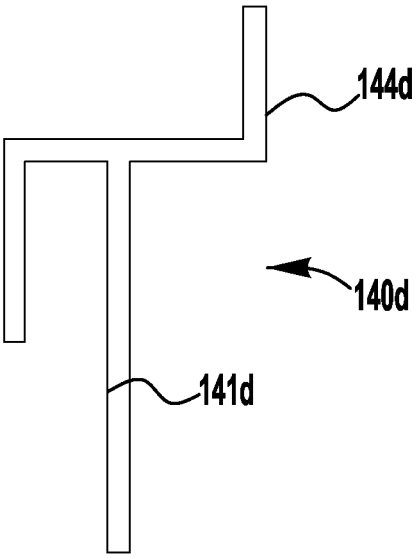
Figure 3E:
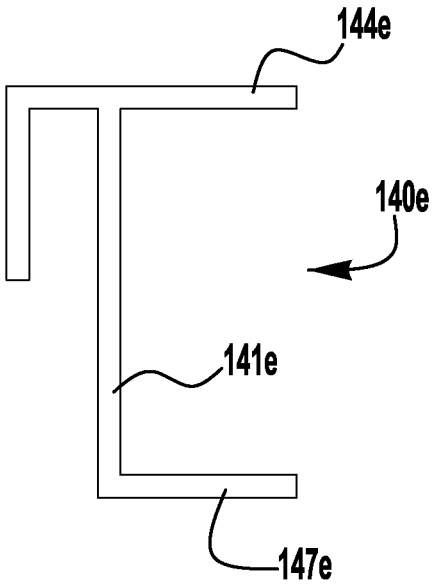
Figure 3F:
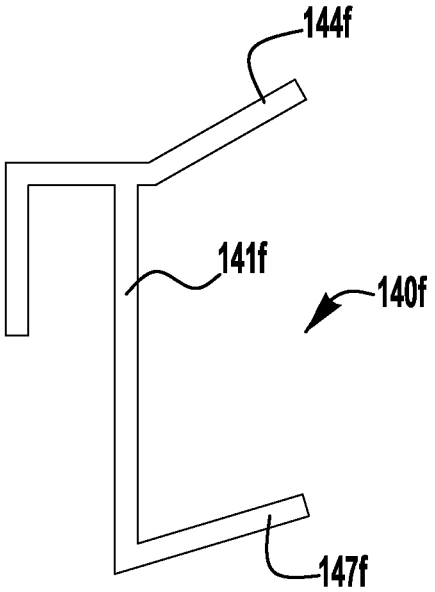
Figure 3G:
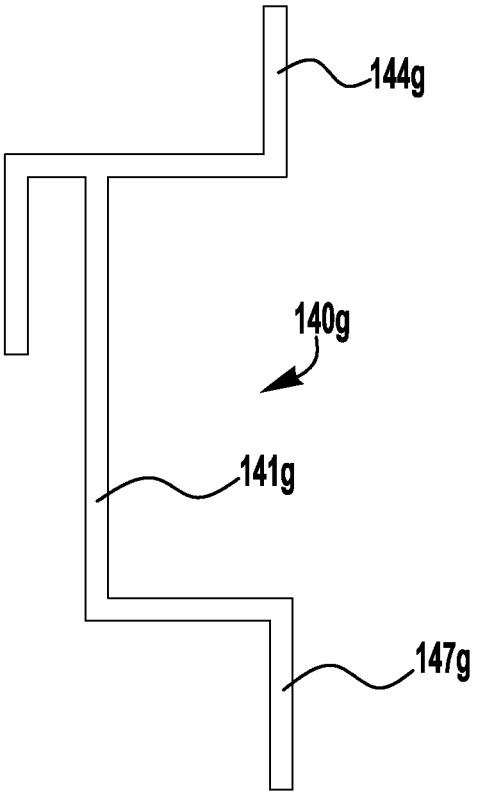
Figure 3H:
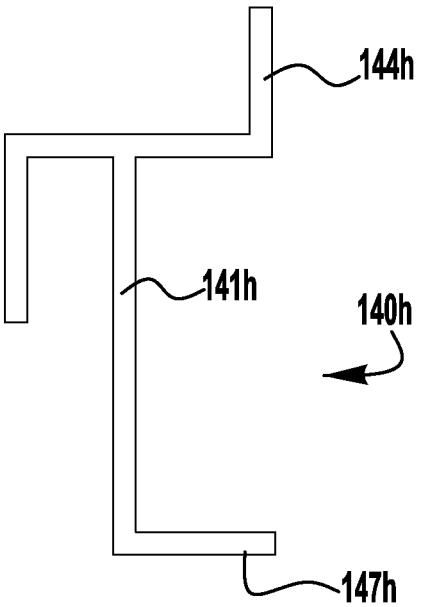

The hanger body may, but need not, have a substantially uniform cross-sectional shape along its length. A variety of suitable cross-sectional shapes may be utilized, examples of which are shown schematically in FIGS. 3A-3H. For example, a hanger body 140*a-d* may include a leg portion 144*a* extending vertically from (e.g., collinear with) the base portion 141*a* (FIG. 3A), a leg portion 144*b* extending forward from the base portion 141*b* (FIG. 3B), or a leg portion 144*c*, 144*d* that extends both vertically and forward from the base portion 141*c*, 141*d* (FIGS. 3C, 3D). The hanger body may also include a second (e.g., lower) leg portion extending into a second (e.g., lower) leg portion of the channel, which may (but need not) be shaped symmetrical to the first (e.g., upper) leg portion. FIGS. 3E-3H illustrate exemplary hanger bodies 140*e-h* including first and second (e.g., upper and lower) leg portions 144*e-h*, 147*e-h* of varying configurations.

Figure 4:
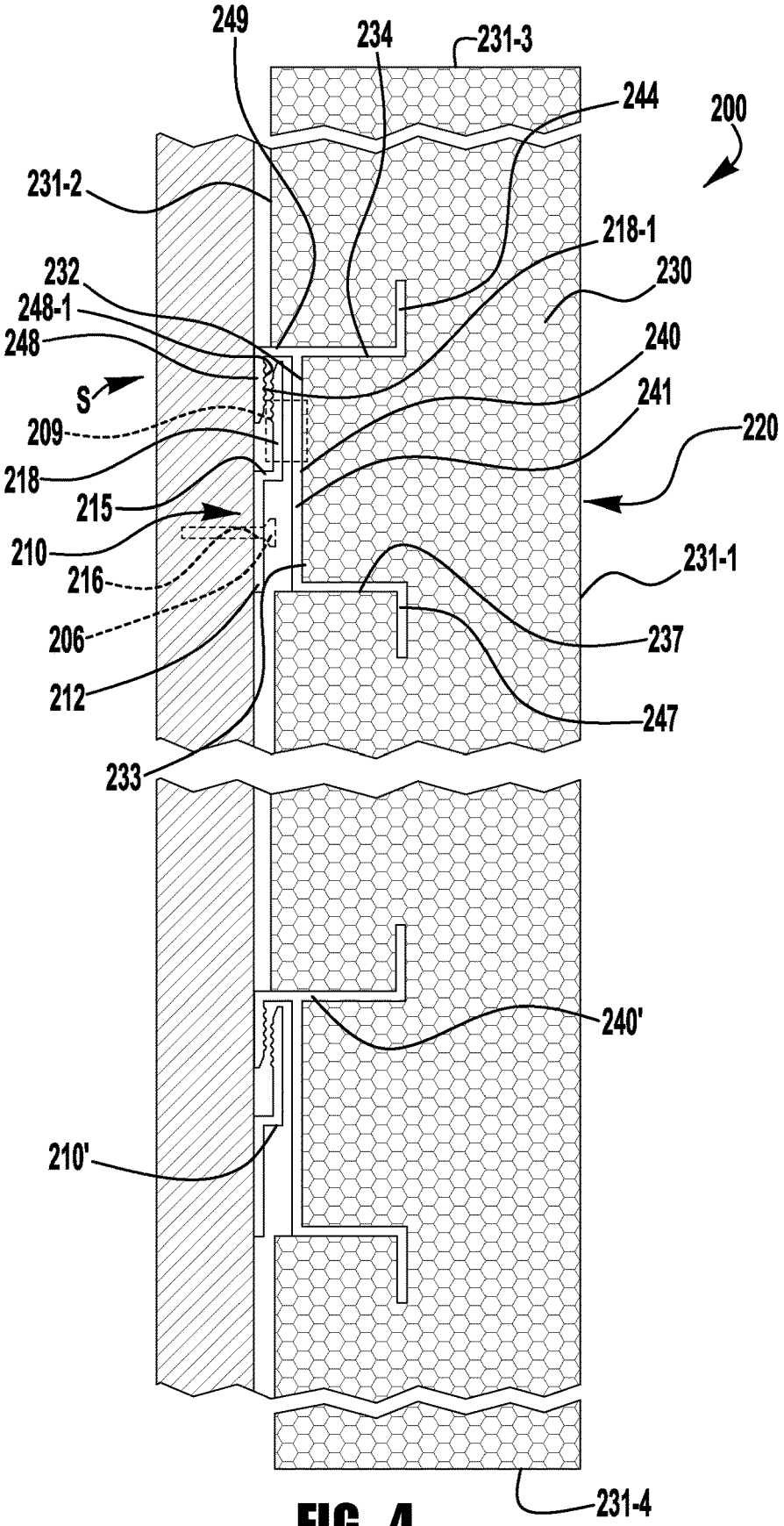
FIG. 4 illustrates a cross-sectional view of a panel system, according to an exemplary embodiment of the present disclosure.
Figure 7:
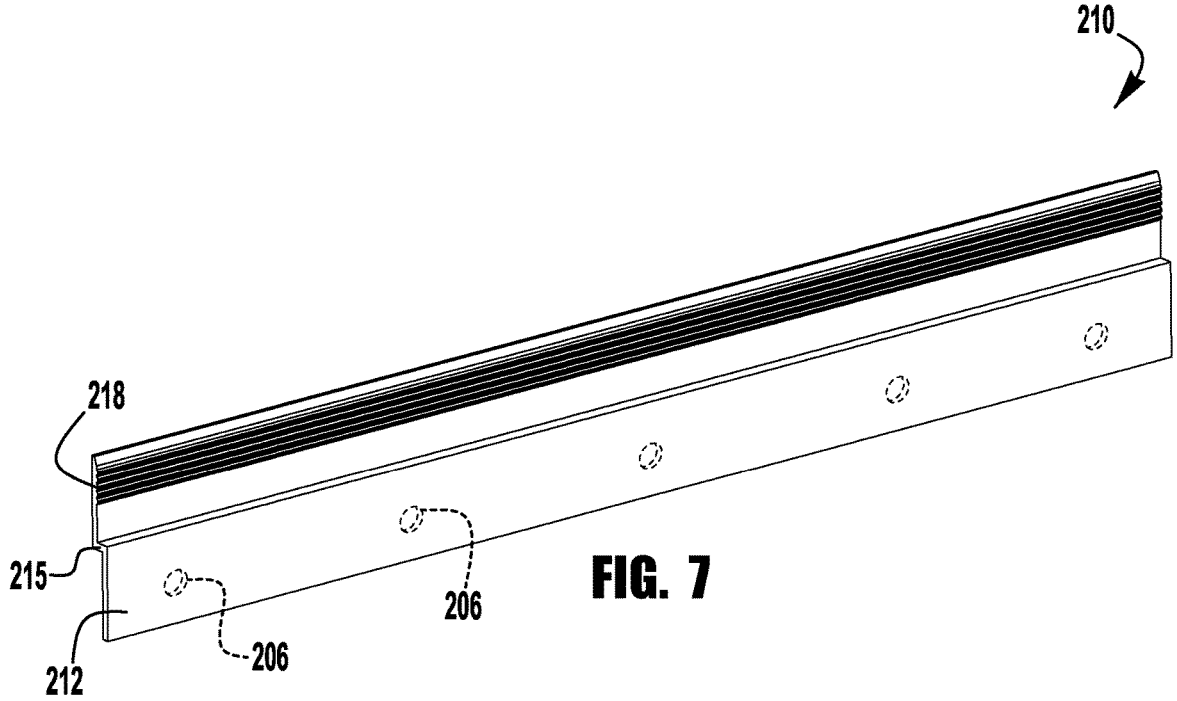
FIG. 7 illustrates a rear perspective view of the mounting rail of the panel system of FIG. 4.

FIG. 4 illustrates an exemplary panel system 200 including a Z-shaped frame member or mounting rail 210 and at least one panel 220. The mounting rail 210 includes a base wall portion 212 securable to a substrate S by one or more fasteners 206 installed through corresponding mounting holes 216 in the mounting rail, a bight portion 215 extending forward from the base wall portion 212, and a flanged portion 218 extending vertically upward from the bight portion 215. The mounting rail 210 may be provided as an elongated rail, as shown in FIG. 7, having a longitudinal length sized to accommodate one or more panels 220. Alternatively, multiple shorter mounting rails may be affixed to a substrate to provide multiple discrete supporting flanges for a hanger body of a panel. The mounting rail may be provided in a suitable rigid material, including, for example, extruded aluminum, steel, and/or other metals.

Figure 5:
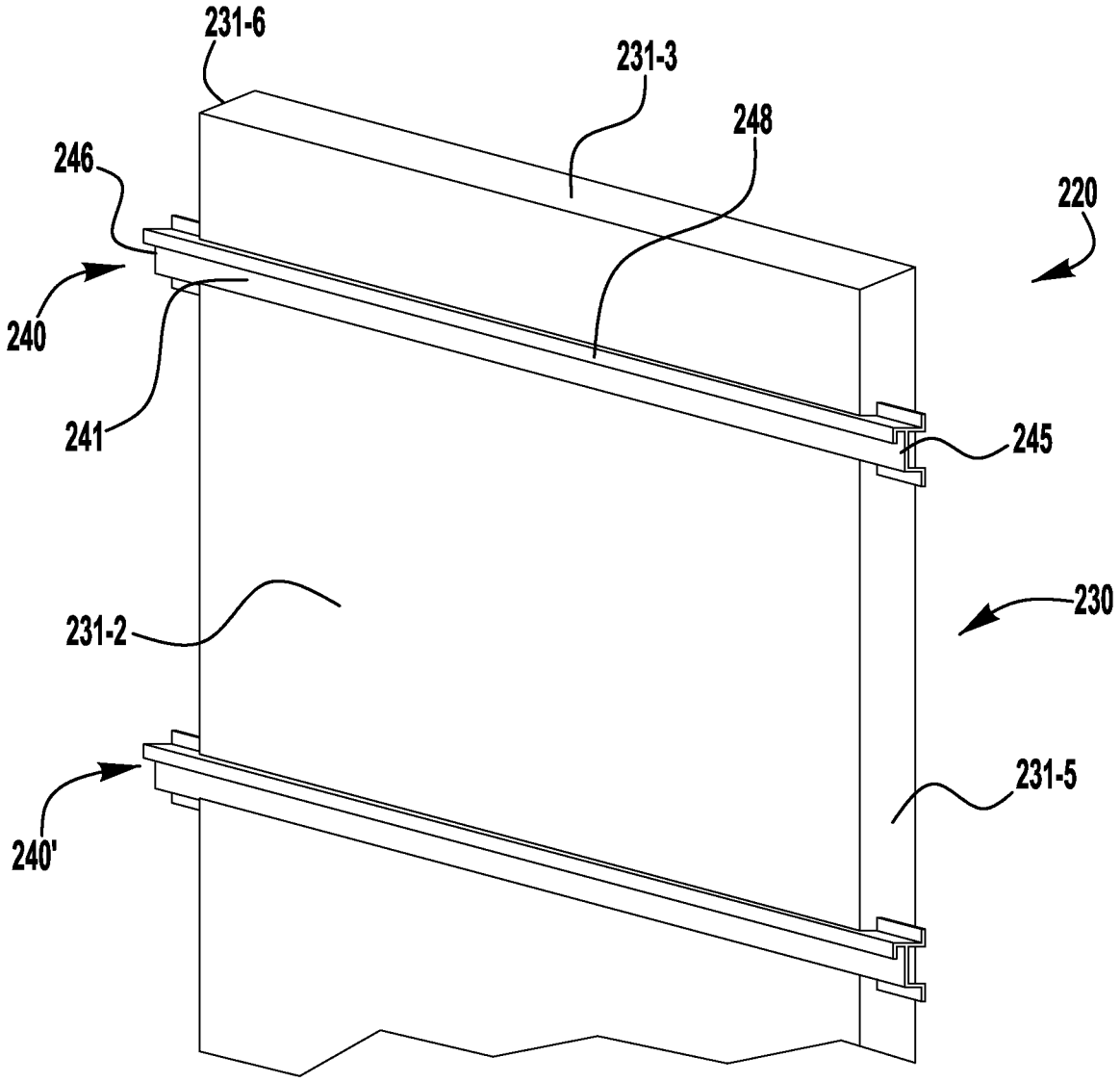
FIG. 5 illustrates a rear perspective view of the panel of the panel system of FIG. 4.

The panel 220 includes a panel body 230 and a hanger body 240 embedded in the panel body. The panel body 230 includes a front surface 231-1, a rear surface 231-2, longitudinal (e.g., top and bottom) side surfaces 231-3, 231-4, and lateral (e.g., left and right) side surfaces 231-5, 231-6 (FIG. 5). A channel 232 is formed in the panel body 230, having a recessed portion 233 recessed from the rear surface 231-2 and first and second L-shaped leg portions or grooves 234, 237 extending into the panel body 230, toward the front surface 231-1 and toward the top and bottom longitudinal surfaces 231-3, 231-4 from first and second ends of the recessed portion 233. The panel body may be formed from a variety of materials, including, for example, expanded polystyrene and/or other foam insulating materials. In some embodiments, the panel body may include one or more exterior coatings or coverings that define the outer surfaces of the panel body.

Figure 6:
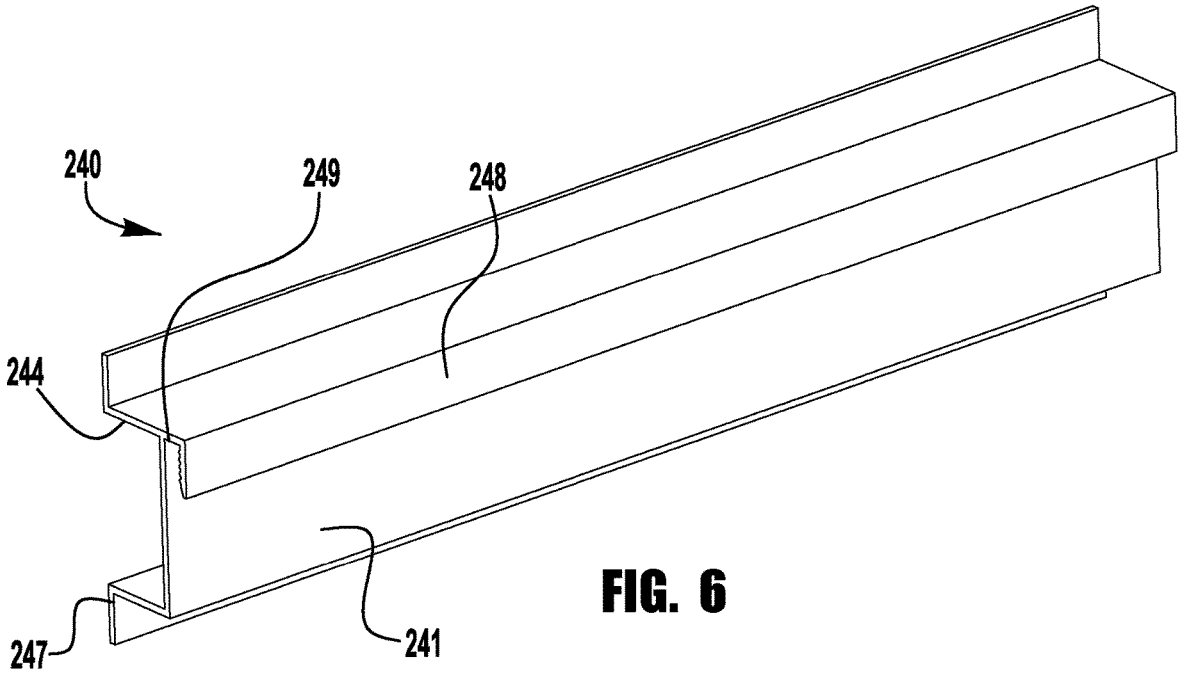
FIG. 6 illustrates a rear perspective view of the hanger body of the panel system of FIG. 4.

The hanger body 240 includes a base portion 241 disposed in the recessed portion 233 of the channel, L-shaped first and second (or upper and lower) leg portions 244, 247 extending from first and second (upper and lower) ends of the base portion (forming a "hat channel" type frame member), into the L-shaped grooves 234, 237 of the channel 232, and a hook portion 248 extending rearward from the base portion 241 and over the flanged portion 218 of the mounting rail 210 to secure the panel 220 on the mounting rail. As shown, a bight portion 249 of the hook portion may be aligned with the upper leg portion 244 of the hanger body. The hanger body may be provided in a suitable rigid material, including, for example, extruded aluminum, steel, and/or other metals. While the illustrated hanger body 240 is a single piece or monolithic frame member (see FIG. 6), in other embodiments, two or more components may be assembled (e.g., snap fit, attached using fasteners, or retained together by the panel body channel) to form the hanger body.

To construct the panel 220, a channel may be formed in the panel body 230, using, for example, a hot wire cutting operation. The hanger body 240 may then be slid into the channel from a later side surface 231-5, 231-6 of the panel body 220.

When the panel 220 is mounted to the mounting rail 210, the flanged portion 218 of the mounting rail may be closely received between the hook portion 248 and the base portion 241 to facilitate rigid retention of the panel 220 on the mounting rail 210, while allowing for adjustability. In one example, the flanged portion 218 of the mounting rail has a thickness of approximately 5/64 inch, and the hook portion 248 and base portion 241 of the hanger body 240 define a gap of approximately 3/16 inch. Other suitable thicknesses of the mounting rail 210 and/or hanger body 240 may additionally or alternatively be utilized depending, for example, on anticipated wind loads—for example, thicknesses between about 1/16 inch and about 1/4 inch (e.g., about 1/16 inch, about 1/8 inch). In other embodiments, a looser or tighter fit (including press or interference fit) may be provided as desired. As shown, the flanged portion 218 and hook portion 248 may be provided with facing serrated surfaces 218-1, 248-1 to provide some degree of cinching engagement between the flanged portion and the hook portion.

To allow the rear surface 231-2 of the panel body 230 to abut or closely align with the mounting surface of the substrate S, the recessed portion 233 of the channel 232 may be sized such that the base portion 241 of the hanger member 240 is recessed from the rear surface 231-2 of the panel body 230, allowing the flanged portion 218 of the mounting rail 210 to be at least partially received in the recessed portion 233 of the channel 232. The hook portion 243 of the hanger body 240 may (but need not) extend or protrude rearward beyond the rear surface 231-2 of the panel body 230.

To further secure the panels 220 to the substrate S, and/or to secure the panels 220 against longitudinal sliding movement, the panels may additionally be affixed to the substrate using one or more secondary attachments, in addition to the hanging support of the mounting rail(s) 210. In some embodiments, such as those utilizing multiple discrete supporting flanges, the panel may be additionally secured to the substrate S by an adhesive (e.g., a 3/8-1/2 inch thick layer of an acrylic-modified adhesive such as Dryvit Primus adhesive, AEPS, or Genesis). In other embodiments, the hanger body 240 may extend beyond either or both of the lateral sides 231-5, 231-6 of the panel body 230 to provide mountable (e.g., defining a mounting hole) end portions or apertured mounting tabs 245, 246 securable (e.g., by screws or other fasteners) to the substrate. In still other embodiments, a fastening clip (shown schematically at 209 in FIG. 4) may be secured over either or both of the lateral ends of the mounting rail flanged portions and hanger body hook portions to secure the panel 220 against longitudinal sliding movement on the mounting rail 210. In such an arrangement, the lateral ends of the hanger body may be substantially flush with the lateral side surfaces of the panel body.

As shown in FIGS. 4 and 5, the panel 220 may be provided with multiple, vertically spaced hanger bodies 240, 240' to be supported by multiple, vertically spaced mounting rails (or by a mounting rail having multiple, vertically spaced flanges, as shown in FIG. 2D), for example, to provide additional rigidity and hanging support for the panel.

Figure 8:
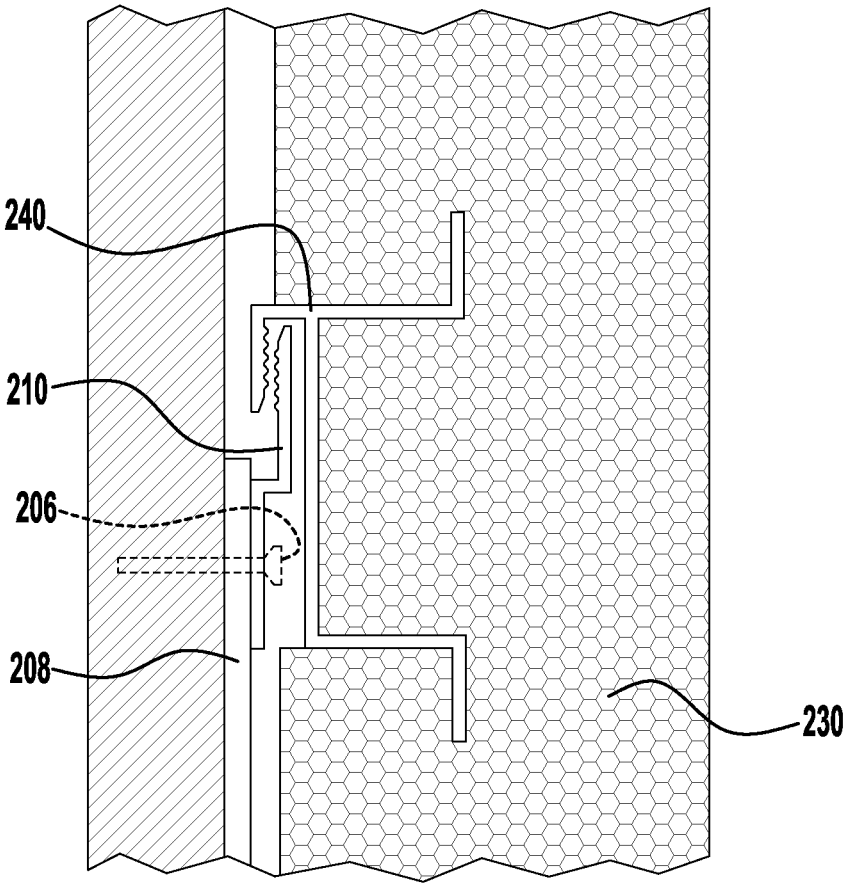
FIG. 8 illustrates a cross-sectional view of the panel system of FIG. 4, shown with the mounting rail spaced apart from the substrate by shims to define a drainage plane between the substrate and the panel, according to an exemplary embodiment of the present disclosure.
Figure 9:
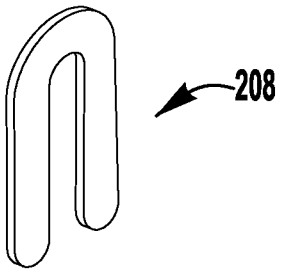
FIG. 9 illustrates a perspective view of an exemplary horseshoe shim for providing a drainage plane between the substrate and the panel.

According to another aspect of the present disclosure, spacers or shims may be provided between the mounting rails and the substrate to provide a drainage plane between the substrate and the panel. FIG. 8 illustrates a side view of the mounted panel system 200, including one or more spacers 208 (e.g., a horseshoe shim, as shown in FIG. 9) installed over the mounting rail fasteners 206 and secured between the mounting rail 210 and the substrate S to provide gaps between the mounting rails and the substrate.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Parameters identified as "approximate" or "about" a specified value are intended to include both the specified value and values within 10% of the specified value, unless expressly stated otherwise. Further, it is to be understood that the drawings accompanying the present disclosure may, but need not, be to scale, and therefore may be understood as teaching various ratios and proportions evident in the drawings. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

I claim:

1. A panel system comprising:

a mounting rail including a base wall portion securable to a substrate, a bight portion extending forward from the base wall portion, and a flanged portion extending vertically upward from the bight portion; and a panel comprising:

a panel body having front, rear, longitudinal side and lateral side surfaces, and a channel having a recessed portion recessed from the rear surface and a leg portion extending into the panel body from a first longitudinal end of the recessed portion; and a hanger body having a base portion disposed in the recessed portion of the channel, a leg portion extending forward from a first longitudinal end of the base portion, into the leg portion of the channel, and a hook portion extending rearward from the base portion and over the flanged portion of the mounting rail to secure the panel on the mounting rail.

2. The panel system of claim 1, wherein the leg portion of the channel comprises an L-shaped groove.

3. The panel system of claim 1, wherein the panel body comprises a second leg portion extending into the panel body from a second longitudinal end of the recessed portion, and the hanger body comprises a second leg portion extending forward from a second longitudinal end of the base portion, into the second leg portion of the channel.

4. The panel system of claim 1, wherein the hook portion extends rearward beyond the rear surface of the panel body.

5. The panel system of claim 1, wherein the hanger body comprises a hat channel frame member defining the base portion and the leg portion.

6. The panel system of claim 1, wherein a bight portion of the hook portion is aligned with the leg portion of the hanger body.

7. The panel system of claim 1, wherein the hanger body extends along an entire longitudinal length of the panel body.

8. The panel system of claim 1, wherein first and second lateral ends of the hanger body are substantially flush with the lateral side surfaces of the panel body.

9. A mountable panel comprising:

a panel body having front, rear, longitudinal side and lateral side surfaces, and a channel having a recessed portion recessed from the rear surface and a leg portion extending into the panel body from a first longitudinal end of the recessed portion; and a hanger body having a base portion disposed in the recessed portion of the channel and recessed from the rear surface of the panel body, a leg portion extending forward from a first longitudinal end of the base portion, into the leg portion of the channel, and a hook portion extending rearward from the base portion;

wherein first and second lateral ends of the hanger body extend beyond the lateral side surfaces of the panel body to define apertured mounting tabs.

10. The panel system of claim 1, wherein the hanger body comprises a monolithic frame member defining each of the base portion, the leg portion, and the hook portion.

11. The panel system of claim 1, wherein the channel is a first channel and the hanger body is a first hanger body, the panel body further comprising a second channel having a recessed portion recessed from the rear surface and a leg portion extending into the panel body from a first longitudinal end of the recessed portion, the panel further comprising a second hanger body having a base portion disposed in the recessed portion of the second channel and recessed from the rear surface of the panel body, a leg portion extending forward from a first longitudinal end of the base portion, into the leg portion of the second channel, and a hook portion extending rearward from the base portion.

12. The panel system of claim 10, wherein the second channel is vertically offset from the first channel.

13. The panel system of claim 1, wherein the panel body comprises a foam insulating material.

14. The panel system of claim 1, wherein the mounting rail is a Z-shaped frame member.

15. The panel system of claim 1, wherein the base wall portion of the mounting rail is securable to the substrate by at least one fastener installed through at least one mounting hole in the base wall portion.

16. The panel system of claim 1, wherein the flanged portion of the mounting rail extends into the recessed portion of the panel body channel.

17. A method of mounting a panel to a substrate, the method comprising:

providing a mounting rail including a base wall portion, a bight portion extending forward from the base wall portion, and a flanged portion extending vertically upward from the bight portion;

affixing the base wall portion of the mounting rail to the substrate;

providing a panel including a panel body including a channel having a recessed portion recessed from a rear surface of the panel body and a leg portion extending into the panel body from a first longitudinal end of the recessed portion, and a hanger body having a base portion disposed in the recessed portion of the channel, a leg portion extending forward from a first longitudinal end of the base portion, into the leg portion of the channel, and a hook portion extending rearward from the base portion;

inserting the hook portion over the flanged portion of the mounting rail to secure the panel on the mounting rail.

18. The method of claim 17, wherein inserting the hook portion over the flanged portion of the mounting rail comprises receiving the flanged portion of the mounting rail in the recessed portion of the panel body channel.

19. The method of claim 17, wherein affixing the base wall portion of the mounting rail to the substrate comprises installing one or more spacers between the mounting rail and the substrate to define a drainage plane between the substrate and the panel.

20. The method of claim 17, wherein affixing the base wall portion of the mounting rail to the substrate comprises installing at least one fastener through at least one mounting hole in the base wall portion.

* * * * *